United States Patent [19]

Reynolds

[11] Patent Number: 4,612,868

[45] Date of Patent: Sep. 23, 1986

[54] SAIL SYSTEM WITH ADJUSTABLE SAIL AREA

[76] Inventor: Randall H. Reynolds, 506 35th St., Newport Beach, Calif. 92663

[21] Appl. No.: 561,040

[22] Filed: Dec. 13, 1983

[51] Int. Cl.[4] ..... B63B 35/00

[52] U.S. Cl. ..... 114/39; 114/103

[58] Field of Search ..... 114/90–91, 114/102, 103, 104–108, 39, 39.2

[56] References Cited

U.S. PATENT DOCUMENTS

| | | | |
|---|---|---|---|
| 8,164 | 6/1851 | Brown | 114/90 |
| 95,243 | 9/1869 | Mair | 114/105 |
| 843,822 | 2/1907 | Jennings | 114/105 |
| 2,247,219 | 6/1941 | Childs | 114/104 |
| 3,974,791 | 8/1976 | Haarstick et al. | 114/103 |

FOREIGN PATENT DOCUMENTS

| | | | |
|---|---|---|---|
| 2714271 | 10/1978 | Fed. Rep. of Germany | 114/104 |
| 2823418 | 12/1979 | Fed. Rep. of Germany | 114/39.2 |
| 3217513 | 2/1983 | Fed. Rep. of Germany | 114/102 |
| 2496589 | 6/1982 | France | 114/90 |
| 2497761 | 7/1982 | France | 114/102 |
| 30892 | 2/1983 | Japan | 114/90 |

*Primary Examiner*—Galen Barefoot
*Assistant Examiner*—Jesûs D. Sotelo
*Attorney, Agent, or Firm*—Fulwider, Patton, Rieber, Lee & Utecht

[57] ABSTRACT

A sail and mast assembly for a wind-driven craft, such as a sail board, includes a main sail section and one or more removable sail sections attachable to the foot of the main sail section, thereby to provide a sail with adjustable sail area to suit varying wind conditions. The assembly also includes an adjustable-height mast, to which the sail is operatively attached, whereby the mast height can be changed, as removable sail sections are addded or removed, to maintain a desired proportion between the mast height and the length of the leading edge or luff of the sail. In a first embodiment, the mast height is adjustable by a telescoping mechanism, while in a second embodiment, the mast height is changed by attaching or removing mast segments to the bottom of the mast.

9 Claims, 6 Drawing Figures

SAIL SYSTEM WITH ADJUSTABLE SAIL AREA

BACKGROUND OF THE INVENTION

The present invention relates, generally, to the field of sail and mast assemblies for sailing vessels. More specifically, the invention relates to a sail and mast assembly of the type commonly found on sailboards and small sail boats, in which the sail area is easily adjustable to suit various wind conditions and sailing skills.

The popularity of sail-driven surf boards, frequently termed "sailboards," has been increasing in recent years. Briefly described, a sailboard comprises a buoyant elongated platform or board having a tapered "bow", on which a mast carrying a sail is mounted. The mast is mounted to the board by means of a universal joint, allowing the mast to be turned and twisted, by means of a laterally-extending boom, to adjust the attitude of the sail with respect to the wind, thereby controlling the speed and course of the board.

The sail on sailboards usually has a fixed, non-adjustable area. The area of the typical sailboard sail (i.e., approximately 60 to 64 square feet) reflects a compromise between a larger sail suitable for light wind conditions (a "light air" sail) and a smaller one adapted for heavier wind conditions (a "heavy air" sail). Thus, the typical sail is an attempt to optimize performance in average wind conditions, and is, therefore, not suited for optimal performance in light or heavy wind conditions.

Enthusiasts who seek optimum performance and handling at all times therefore resort to the use of different size sails for differing wind conditions. Aside from the expense involved in purchasing two or three different sails, there is the inconvenience of changing sails as wind conditions change, which necessitates the beaching of the board.

It has also been found that those who are inexperienced in the use of a sailboard find it easier to learn the necessary skills with a smaller sail, such as a heavy air sail. Thus, if a sailboard is to be used by both a novice and an experienced user, an additional sail must be purchased.

The use of a separate heavy air sail has a further disadvantage, in that the leading edge ("luff") of the sail starts two or three feet from the top of the mast. This results in compromised sail handling, due to the carrying of unnecessary weight aloft.

It has been proposed to adjust the area of a fixed sail by removing sections of the sail from its trailing edge, or leech. While this procedure allows the use of a fixed-length mast, a disadvantage exists in the rather drastic change in sail shape which results. Specifically, the leech is moved closer to the line of maximum sail curvature (the "draft line"), and this can degrade the optimal sail shape, in which the draft line is located approximately one-third to one-half of the distance from the luff to the leech.

Thus, there exists a long-felt, but unsatisfied need for a sail and mast assembly, for sailboards and the like, which allows adjustment of the total sail area without degrading the aerodynamic characteristics of the sail, or its handling qualities. Moreover, it would be advantageous for such an assembly to provide for ease and convenience in adjusting the sail area, while being capable of incorporation into existing sailboard designs.

SUMMARY OF THE INVENTION

Broadly, the present invention is a sail and mast assembly in which sail area is adjusted by means of at least one removable section or panel attached along the bottom edge, or "foot," of the sail, and in which the height of the mast is adjustable as a sail panel is removed or added.

More specifically, the sail comprises a main sail section, the foot of which includes fastening means which allows the removable attachment of a transverse section or panel. The panel increases the length of the sail's luff and leech, thereby also increasing the overall area of the sail. Two or more such panels can be used, if desired, in which case the panels will include attachment means on their upper and lower edges. (The attachment means can, of course, be omitted from the lower edge of the lowest panel.)

The mast is adjustable in height, as mentioned above, to accommodate changes in the length of sail luff, as panels are added or removed. In one embodiment, mast height is adjustable by means of telescoping upper and lower mast sections. As an alternative, the mast can include one or more removable mast segments serially attached to the bottom of the mast, with each mast segment having a length approximately equal to the length of luff added by a corresponding sail panel. Thus, with either the telescoping mast or the segmented mast, the mast height can be adjusted, as sail panels are added or removed, to maintain the same proportion of mast height to sail luff.

In a first preferred embodiment, the sail sections are joined along their adjacent edges by means of a zipper or a series of snap fasteners or the like. In this embodiment, the panels can be configured so that each panel can provide an additional amount of seam shape to the sail. In this manner, the fullness of the sail can be increased and decreased as panels are added and removed, respectively, thereby enhancing the sail's adjustability to varying wind conditions.

The sail area is easily and quickly adjusted to suit wind conditions varying from light air to heavy air. Moreover, when used on a sailboard, the invention allows the same board to be used by both a novice and an experienced enthusiast without completely changing the entire sail. Furthermore, the changes in sail area are accompanied by appropriate changes in mast height, hereby maintaining the proper relationship between mast height and sail luff, and avoiding the problem, mentioned above, of excess weight aloft in heavy air. In addition, the draft of the sail can be maintained at its optimum position regardless of the sail area selected, since all sail area is added or removed from the foot, rather than the leech.

As will be appreciated from the detailed description which follows, these and other advantages are provided by a sail and mast assembly, in accordance with the invention, which is economical to manufacture, easy to use, and readily adaptable for use with both sailboards and small sail boats, as well as other types of wind-driven craft.

DETAILED DESCRIPTION OF THE INVENTION

In the detailed description of the invention which follows, the invention will be described in conjunction with a sailboard. Although the invention may find its principal utility when used with a sailboard, it should be noted at the outset that, with minor modifications which would be apparent to those skilled in the pertinent arts, the invention can be incorporated into small sail boats of varying configurations, as well as other types of wind-driven craft.

Figure 1:
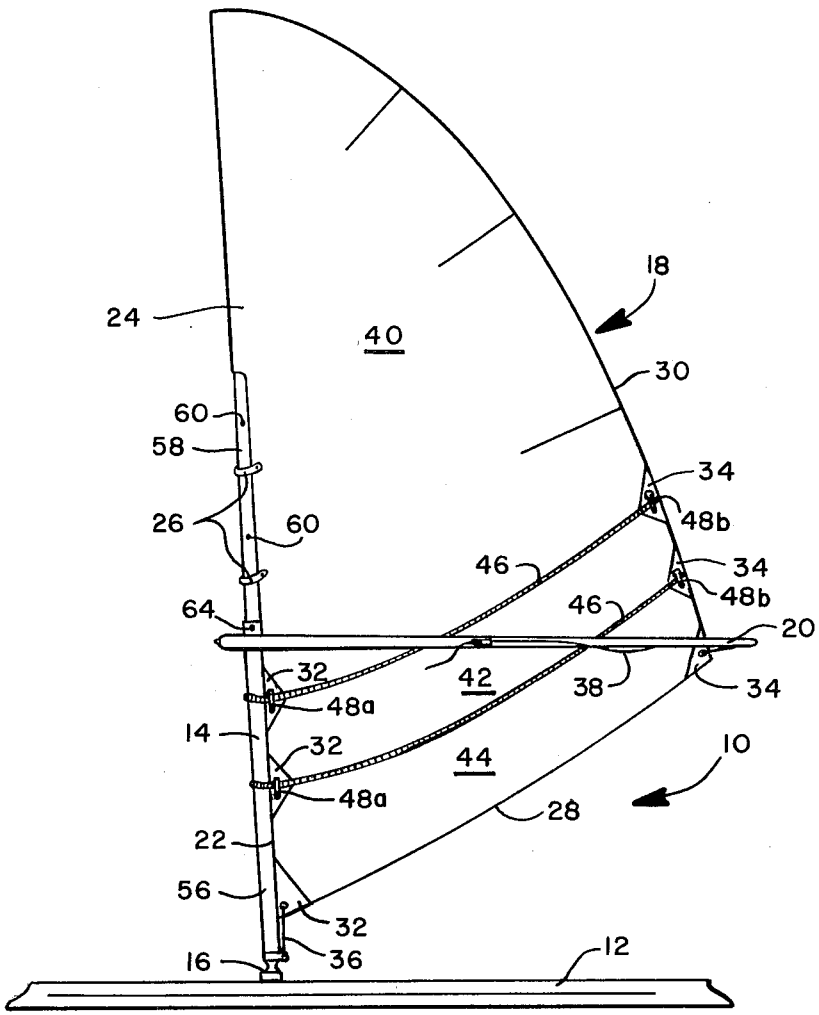
FIG. 1 is a side elevational view of a sailboard incorporating a sail and mast assembly in accordance with a first preferred embodiment of the present invention.

Referring first to FIG. 1, a sailboard 10 is shown with a sail and mast assembly in accordance with a first preferred embodiment of the invention. The sailboard in most respects is of typical design, having a platform or board 12 on which a person stands, a mast 14 mounted on the board 12 by means of a universal joint 16, and a fore-and-aft rigged sail 18 carried on the mast 14. A boom 20 extends horizontally rearwardly from the mast 14, and is used to rotate the mast on the universal joint 16 to change the attitude of the sail 18 with respect to the wind, thereby to navigate.

The sail has a leading edge or "luff" 22 part of which forms a sleeve 24 into which is inserted the upper part of the mast. Below the sleeve 24, the luff 22 is attached to the mast by one or more straps 26. The sail 18 has a bottom edge or "foot" 28 extending from the luff 22 to the sail's trailing edge or "leech" 30, which extends distally from the mast. At the juncture between the foot and the luff, or "tack", is a tack patch 32, and at the juncture between the foot and the leech, or "clew", is a clew patch 34. A downhaul line 36 is connected between the tack patch 32 and the universal joint 16, in a manner to be described below. An outhaul line 38 connects the boom 20 to the clew patch 34. The outhaul line 38 thus connects the sail 18 to the boom 20 so that navigation can be accomplished, as mentioned above.

So far there has been described the important features of a conventional sailboard, by way of setting forth an exemplary environment for the present invention. Henceforth, the features of the present invention will be described in detail.

Figure 4:
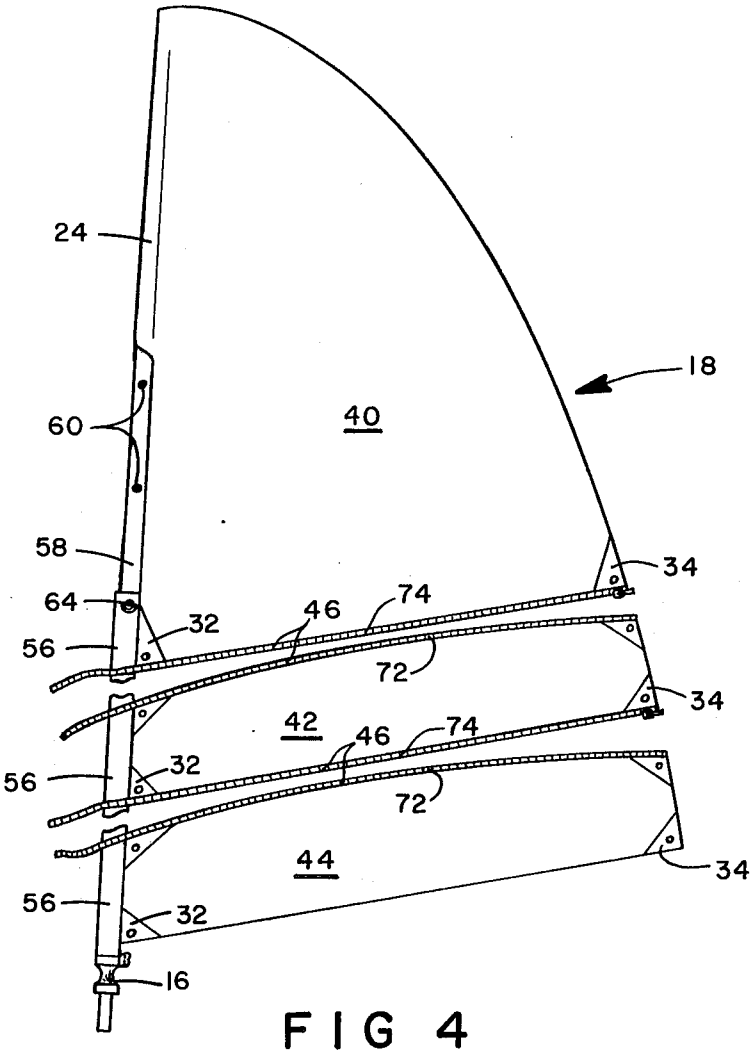
FIG. 4 is a side-elevational view of the sail and mast assembly, similar to the view of FIG. 1, but showing the sail sections in an unattached relationship.

As will be seen shortly, a key feature of the invention is that the sail area is adjustable by the addition and removal of sections or panels along the sail's foot, and that the height of the mast is adjustable in accordance with the changes in the length of the luff resulting from the addition and removal of the sail panels. In accordance with this concept, the sail 18 is divided into a main sail section 40 and two panels 42 and 44 removably attached to the bottom edge of the main section 40. More specifically, the first panel 42 is attachable along its upper edge to the bottom edge, or "foot", of the main section 40, while the second, or lowermost panel 44 is attachable along its upper edge to the lower edge, or "foot", of the first panel 42. Each of the panels 42 and 44 has a luff edge alignable with the luff edge of the main sail section 40. As best shown in FIG. 4, the panels 42 and 44 are separately attachable and removable, so that the sail 18 can be rigged with both of the panels, or just one, or none (using the main section 40 alone).

Figure 2:
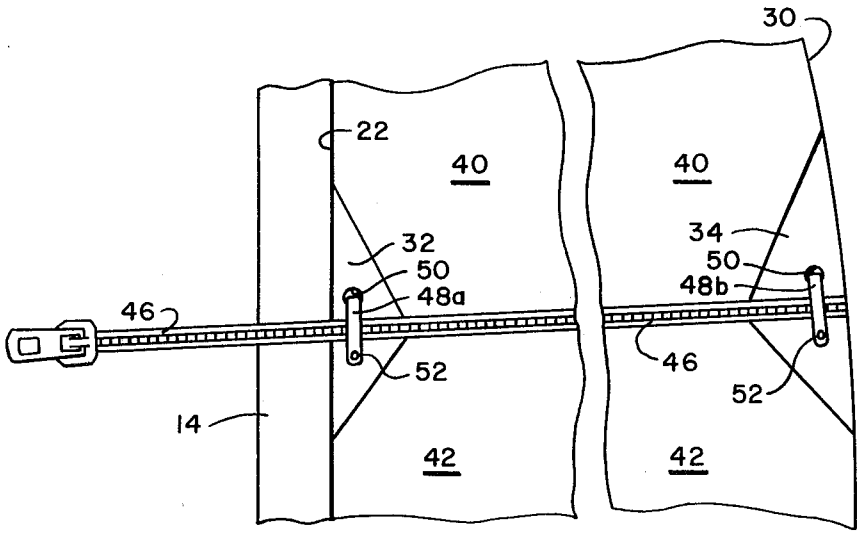
FIG. 2 is a detailed view of a portion of the sail and mast assembly of FIG. 1, showing a preferred means of attaching the sail sections used in the first preferred embodiment.

As best shown in FIGS. 2 and 4, the preferred means for removably attaching adjacent sail sections is a zipper 46, two of which are used in the illustrated embodiment. As will be described in greater detail below, the zippers 46 provide seams along which adjacent sail sections are joined together, with the two sides of each zipper 46 being sewn into either side of each of these seams. For reinforcement along the seams defined by the zippers 46, fore and aft load straps 48*a* and 48*b*, respectively, are provided at the upper corners of each of the removable panels 42 and 44. The load straps 48*a* and 48*b* pass through grommets 50 in the tack patch 32 and clew patch 34 of the adjacent sail section, looping around the zipper 46 between the two sections, and are fastened by means such as snap fasteners 52 or the like.

Figure 3:
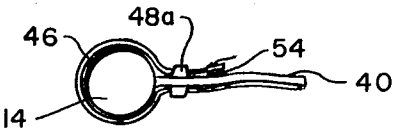
FIG. 3 is a cross-sectional view of the mast and an attached sail section, showing the placement of a zipper used to attach the sail section.

The zippers 46 extend forward beyond the luff, as shown in FIG. 2, so that they can be wrapped around the mast and tucked under the forward load straps 48*a*, as shown in FIG. 3. The free end of the zipper can then be fastened to the side of the sails sections by a suitable fastener 54, which may be a snap or a VELCRO fastener.

It should be noted at this point that, although zippers are shown as the preferred means of attaching adjacent sail sections, other means can be used. For example, snap fasteners or self-adhesive strips (such as VELCRO) may be used as alternatives.

Figure 6:
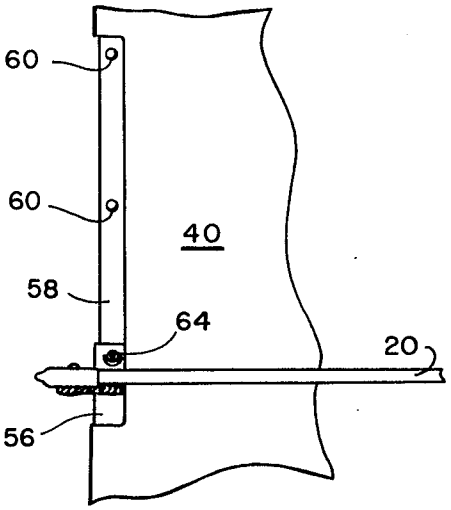
FIGS. 5 and 6 are detailed elevational views of portions of the mast used in the first preferred embodiment of the invention, as incorporated into the sailboard of FIG. 1.
Figure 5:
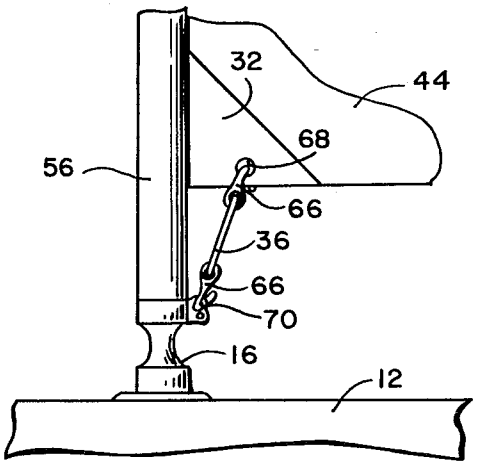

The structure of the mast 14 is best shown in FIGS. 4, 5, and 6. As shown, the mast has a "telescoping" structure to allow adjustment of its height. Accordingly, the mast comprises a lower tubular section 56 attached to the universal joint 16, and an upper tubular section 58 which slidably fits into the open upper end of the lower section 56. The upper section 58 is provided with a plurality of holes 60 which are each registrable with a hole (not shown) near the top of the lower mast section 56. A pin 64 is insertable into the registered holes to fix the mast at the desired height. The number of holes 60 may advantageously correspond to the number of sail sections, with the spacing between the holes 60 corresponding, at least approximately, to the length of luff of each of the removable sail sections.

As previously mentioned, the downhaul line 36 is connected between the tack patch 32 and the universal joint 16. This connection provides the proper downward tensioning of the sail 18, and is accomplished (as shown in FIG. 5), by a pair of hooks 66 insertable into a tack patch grommet 68 and an eyelet 70 on the universal joint 16.

The operation of the preferred embodiment may now be described. In light air, it is desirable to maximize sail area. Therefore, all three sail sections 40, 42 and 44 are employed, as shown in FIG. 1. The mast 14 is extended to its full height and fixed in this position by the insertion of the pin 64 into the lowermost of the holes 60 in the extendable upper mast section. The downhaul line 36 is attached to the tack patch 32 of the lowermost sail section or panel 44, while the outhaul line 38 is attached to the clew patch 34 of the same panel.

In "medium" or moderate air, it may be desirable to have slightly less sail area hoisted. Therefore, the lowermost sail panel 44 can be removed, by means of the zipper 46, and the mast correspondingly shortened by telescoping the upper mast section 58 into the lower mast section 56 until the middle one of the holes 60 is in registration with the hole in the lower mast section, with the pin 64 then being inserted therethrough. The outhaul and downhaul lines are connected to the clew and tack patches, respectively, of the middle sail panel 42.

In heavy air (or when the sailboard is to be used by a novice) the minimum sail area is desired. In this situation, both panels 42 and 44 will be unzipped from the main sail section 40, and the mast 14 will be shortened to its minimum height by sliding the upper mast section 58 into the lower mast section 56 until the uppermost of the holes 60 registers with the hole in the lower mast section and then inserting the pin 64, as described above. The outhaul line and the downhaul line will then be attached to the clew patch and tack patch, respectively, of the main sail section.

It will be appreciated that sail area can be increased by re-attaching the panel 42 alone, or both of the panels 42 and 44, while correspondingly increasing the mast height.

From the foregoing description, several features of the invention may be noted. First, since sail area is added to, or removed from, the foot of the sail, the position of the draft line with respect to the luff and the leech will not change as area is adjusted. Moreover, the mast height is always adjusted proportionately with the changes in the length of the sail's luff as panels are added or removed. This avoids the problem of excessive weight aloft, as would occur with a fixed-height mast. Thus, no compromise in handling occurs in moderate and heavy air conditions due to excess mast height and weight.

Another advantage of the invention can be appreciated by reference to FIG. 4. Here it can be seen that the detachable seams between the sail sections 40, 42, and 44 formed by the zippers 46 can be advantageously located so that each of the removable panels 42 and 44 adds a predetermined amount of aerodynamic curvature to the sail. This curvature is known as "seam shape", and the degree of curvature (i.e., the amount of seam shape) is termed the "fullness" of the sail. The seam shape is provided by a curvature formed along the upper edge 72 of each of the removable panels 42 and 44, whereas the lower edge 74 of each of the sail sections 40 and 42 is substantially straight. Thus, in order to join a panel to the sail section above it, the sail must be bowed out, thereby adding "fullness".

In this manner, full, or medium full, fullness is provided when both panels 42 and 44 are attached. This degree of fullness is optimum for light air conditions. With the lower panel 44 removed, fullness is reduced, preferably to medium fullness, as is preferred in medium wind conditions. With both panels 42 and 44 removed, the sail is only slightly full, due to the removal of all of the seam shape provided by these panels. This slightly full sail is optimal for heavy air conditions.

Thus, it can be appreciated that the preferred embodiment described above provides the optimum sail and mast configuration over a wide range of wind conditions, with ease of adjustability of the sail and mast configuration to accomodate changes in wind conditions. There is no compromise in the handling qualities of the vessel as a result of the adjustability of the sail and mast.

The embodiment described above should be considered exemplary, as there are numerous modifications which may suggest themselves to those skilled in the pertinent arts. For example, as alluded to above, the invention is readily adaptable to wind-driven craft other than sailboards. Thus, modifications within the spirit and scope of the invention may be necessary to adapt the invention for use on such craft as sail boats, ice boats, and land sailers (sailboards with wheels). Moreover, as previously mentioned, the attachment between adjacent sail panels can be accomplished by any number of means, such as self-adhesive strips (e.g., VELCRO) and snap fasteners, for example. Furthermore, while the use of two removable sail panels is preferred, anywhere from one to three, and possibly more, removable panels may be employed, depending upon the particular application. In addition, other equivalent means may be devised for adjusting the mast height. These and other modifications should be considered within the spirit and scope of the invention, as defined in the claims which follow.

What is claimed is:

1. A sail, mast and boom for a wind-driven craft, comprising:

a mast;

a boom attached to the intermediate portion of the mast;

an upper sail section having a luff securable adjacent the mast, a leech extended distally from the mast, a foot at the bottom thereof extending between said luff and said leech, a tack at the juncture between said luff and said foot and a clew at the juncture between said leech and said foot;

a lower sail section having a luff securable adjacent the mast, a leech extended distally from the mast, a foot at the bottom thereof extending between the luff and the leech, a tack at the juncture between the luff and the foot, and a clew at the juncture between the leech and the foot;

readily removable attachment means to continuously seam the upper edge of said lower sail section to the lower edge of said upper sail section from said tacks to said clews;

means for adjusting the height of the mast between a first extended height when the lower sail section is attached to the upper sail section and a second height when the lower sail section is removed from the upper sail section, said second height being lower than said first height by an amount approximately equal to the length of the luff edge of said lower sail section; and with the free end of the boom being secured to the clew of the lower sail section when the lower sail section is attached to the upper sail section and with the free end of the boom being secured to the clew of the upper sail section when the lower sail section is removed from the upper sail section, and also with the tack of the lower sail section being downhauled adjacent the lower portion of the mast when the lower sail section is attached to the upper sail section and the tack of the upper sail section being downhauled to the lower portion of the mast when the lower sail section is removed from the upper sail section.

2. The sail and mast assembly of claim 1 wherein the lower and upper edges of the sail sections are provided with different curvatures whereby the attachment of said edges provides a preselected amount of sail shape to the joined-together said sections.

3. The sail and mast assembly of claim 1 wherein the attachment means is a zipper.

4. The sail and mast assembly of claim 1 which further includes a front load strap that connects the tacks of the upper and lower load sections and a rear load strap that connects the clews of the upper and lower sail sections, with said load straps extending over the seam formed by said attachment means.

5. The sail and mast assembly of claim 2 wherein the attachment means is a zipper.

6. The sail and mast assembly of claim 2 which further includes a front load strap that connects the tacks of the upper and lower load sections and a rear load strap that connects the clews of the upper and lower sail sections, with said load straps extending over the seam formed by said attachment means.

7. The sail and mast assembly of claim 3 which further includes a front load strap that connects the tacks of the upper and lower load sections and a rear load strap that connects the clews of the upper and lower sail sections, with said load straps extending over the seam formed by said attachment means.

8. A sail for a sailboard having a mast and an open boom through which said sail extends, said sail comprising:

an upper sail section having a luff securable adjacent the mast, a leech extended distally from the mast, a foot at the bottom thereof extending between said luff and said leech, a tack at the juncture between said luff and said foot and a clew at the juncture between said leech and said foot;

a lower sail section having a luff securable adjacent the mast, a leech extended distally from the mast, a foot at the bottom thereof extending between the luff and the leech, a tack at the juncture between the luff and the foot, and a clew at the juncture between the leech and the foot;

readily removable attachment means to continuously seam the upper edge of said lower sail section to the lower edge of said upper sail section from said tacks to said clews;

with the free end of the boom being secured to the clew of the lower sail section when the lower rail section is attached to the upper sail section and with the free end of the boom being secured to the clew of the upper sail section when the lower sail section is removed from the upper sail section, and also with the tack of the lower sail section being downhauled adjacent the lower portion of the mast when the lower sail section is attached to the upper sail section and the tack of the upper sail section being downhauled to the lower portion of the mast when the lower sail section is removed from the upper sail section;

with the lower and upper edges of the sail sections being provided with different curvatures whereby the attachment of said edges provides a preselected amount of sail shape to the joined-together sail sections; and a front load strap that connects the tacks of the upper and lower sail sections and a rear load strap that connects the clews of the upper and lower sail sections, said load straps extending over the seam formed by said attachment means.

9. The sail of claim 8 wherein the attachment means is a zipper.

* * * * *